US007442016B2

(12) United States Patent
Dovey et al.

(10) Patent No.: US 7,442,016 B2
(45) Date of Patent: Oct. 28, 2008

(54) SCROLL PUMP AND METHOD OF ASSEMBLING SAME

(75) Inventors: Stephen James Dovey, West Chiltington (GB); Alan John Saunders, Angmering (GB)

(73) Assignee: Edwards Limited, Crawley, West Sussex (GB)

( * ) Notice: Subject to any disclaimer, the term of this patent is extended or adjusted under 35 U.S.C. 154(b) by 325 days.

(21) Appl. No.: 10/544,866

(22) PCT Filed: Feb. 11, 2004

(86) PCT No.: PCT/GB2004/000497

§ 371 (c)(1),
(2), (4) Date: Aug. 5, 2005

(87) PCT Pub. No.: WO2004/072483

PCT Pub. Date: Aug. 26, 2004

(65) Prior Publication Data

US 2006/0051225 A1 Mar. 9, 2006

(30) Foreign Application Priority Data

Feb. 17, 2003 (GB) ..... 0303591.2

(51) Int. Cl.
*F01C 1/02* (2006.01)

(52) U.S. Cl. ..... 418/55.1; 418/55.4

(58) Field of Classification Search ..... 418/55.1, 418/55.2, 55.3, 55.4
See application file for complete search history.

(56) References Cited

U.S. PATENT DOCUMENTS

| | | | | |
|---|---|---|---|---|
| 5,123,364 | A | 6/1992 | Gitman et al. | |
| 6,234,787 | B1 | 5/2001 | Endoh et al. | |
| 6,916,162 | B2 * | 7/2005 | Schofield et al. | 418/55.2 |

FOREIGN PATENT DOCUMENTS

EP 0 802 370 B1 10/1997

OTHER PUBLICATIONS

United Kingdom Search Report of Application No. GB0417378.7; Date of search: Dec. 21, 2004.

* cited by examiner

*Primary Examiner*—Hoang M Nguyen
(74) *Attorney, Agent, or Firm*—Ira Lee Zebrak

(57) ABSTRACT

A method of assembling a scroll pump comprises the following steps carried out sequentially; the step of mounting a first bearing means (20) and drive shaft (14) for rotation relative to a housing (12): the step of fastening a first flange portion (48) of a bellows arrangement (34) relative to the housing (12); the step of fastening an orbiting scroll (26) to a second flange portion (56) of the bellows arrangement (34); and the step of fixing a second scroll (28) relative to the housing (12) for co-operation with the orbiting scroll (26). The second flange portion (56) is fastened to the orbiting scroll (26) with fasteners (60) which extend through a through-bore (61) in the orbiting scroll and engage with the second flange portion.

21 Claims, 3 Drawing Sheets

SCROLL PUMP AND METHOD OF ASSEMBLING SAME

FIELD OF THE INVENTION

The present invention related to a scroll pump and to a method of assembling a scroll pump.

BACKGROUND OF THE INVENTION

A prior art scroll pump 100 is shown in FIG. 3, and comprises a housing 102, a drive shaft 103 having a concentric shaft portion 104 and an eccentric shaft portion 106. The shaft is supported at its concentric portion by bearing means 108, which is fixed relative to housing 102, and is driven by a motor 110 which is mounted in the housing. A second bearing means 112 supports an orbiting scroll 114 on the eccentric shaft portion 106 so that during use rotation of said shaft imparts an orbiting motion to said orbiting scroll 114 which co-operates with a second, fixed, scroll 116 for pumping fluid along a fluid flow path 117 between an inlet and outlet of the pump. The radial clearances between the orbiting and fixed scrolls are accurately controlled so that lubricant is generally not required for scaling. The axial clearances between the scrolls are sealed with tip seals 118. The arrangement means that a scroll pump may be used when it is desired to maintain a dry environment for the pumping media along the fluid flow path. A bellows arrangement 120 isolates the first bearing means and the second bearing means from the fluid flow path, thereby restricting contamination of the pumping media, since the bearing means are generally lubricated. O-ring seals 121 and 122 are disposed between the bellows arrangement and orbiting scroll 114 and housing 102, respectively, to resist the passage of contaminants. The bellows arrangement is sufficiently flexible to allow orbiting motion of the orbiting scroll 114, second bearing means 112 and eccentric shaft portion 106. A counter-weight 123 is provided for balancing the weight of the orbiting components of the pump. The counter-weight is adapted to be fitted about the concentric shaft portion 104 of the drive shaft 103 radially between a flexible portion of the bellows arrangement 120 and the drive shaft 103.

During assemble, shaft 103, bearing means 108 and motor 110 are mounted relative to the housing 102. Counter-weight 123 is fitted onto the drive shaft 103 and fastened with a radially extending fastener of pin 125. Second bearing means 112 is then fixed to a hub 124 of orbiting scroll 114 with fasteners 126 (only one is shown). A flange 128 of the bellows arrangement is then fixed to the orbiting scroll with fasteners 129 (only one is shown). The orbiting scroll 114, second bearing means 112 and bellows arrangement 120 are then inserted together into the housing in the direction shown by arrow A. This assembly step involves passing the flexible portion of the bellows arrangement over the counter-weight, which is relatively awkward to achieve. When is position, flange 130 of bellows arrangement 120 is fastened to the housing by fasteners 132 (only one is shown). The fastening of fastener 132 is a difficult procedure since access to the fastener is through the relatively small gap G between the orbiting scroll 114 and the housing 102. It will be appreciated that insertion of a tool through gap G whilst also maintaining line of sight of fastener 132 is cumbersome and intricate. Once the tool is inserted through gap G there remains the difficulty of passing the bellows arrangement the latter of which has been expanded radially outwardly by the counter-weight 123.

Subsequently, fixed scroll 116 is fixed relative to the housing with fasteners 134 (only one is shown).

It is desirable to provide an improved scroll pump and method of assembling a scroll pump.

BRIEF SUMMARY OF THE INVENTION

The present invention provides a method of assembling a scroll pump, the scroll pump comprising: a housing; a drive shaft having an eccentric shaft portion: first bearing means for supporting said drive shaft for rotation: second bearing means for supporting an orbiting scroll on said eccentric shaft portion so that during use rotation of said shaft imparts an orbiting motion to said orbiting scroll which co-operates with a second scroll for pumping fluid along a fluid flow path between an inlet and outlet of the pump: and a bellows arrangement for isolating said first bearing means and said second bearing means from said fluid flow path and for providing relative rotational location of the orbiting scroll with respect of the second scroll; wherein the method comprises the following steps carried out sequentially: the step of mounting said first bearing means and said drive shaft for rotation relative to said housing; the step of fastening a first flange portion of said bellows arrangement relative to said housing; the step of fastening said orbiting scroll to a second flange portion of said bellows arrangement; an the step of fixing said second scroll relative to said housing for co-operation with said orbiting scroll.

The second bearing means is preferably fastened relative to said orbiting scroll and mounted to said eccentric shaft portion prior to the step of fastening said orbiting scroll to said bellows arrangement.

The orbiting scroll is preferably fastened to said second flange portion of said bellows arrangement with at least one fastener which is inserted through a bore in said orbiting scroll.

The present invention also provides a scroll pump comprising: a housing; a drive shaft having an eccentric shaft portion; first bearing means supporting said drive shaft for rotation; second bearing means supporting an orbiting scroll on said eccentric shaft portion so that during use rotation of said shaft imparts an orbiting motion to said orbiting scroll which co-operates with a second scroll for pumping fluid along a fluid flow path between an inlet and outlet of the pump; and a bellows arrangement isolating said first bearing means and said second bearing means from said fluid flow path; wherein said bellows arrangement has a first flange portion fastened relative to said housing and a second flange portion fastened to said orbiting scroll with at least one fastener which extends through a through-bore in the orbiting scroll and engages with said second flange portion.

Other aspects of the invention are defined in the accompanying claims.

BRIEF DESCRIPTION OF THE DRAWINGS

In order that the present invention may be well understood, an embodiment thereof, which is given by way of example only, will now be described with reference to the Figures, in which.

DETAILED DESCRIPTION OF THE INVENTION

Figure 1:
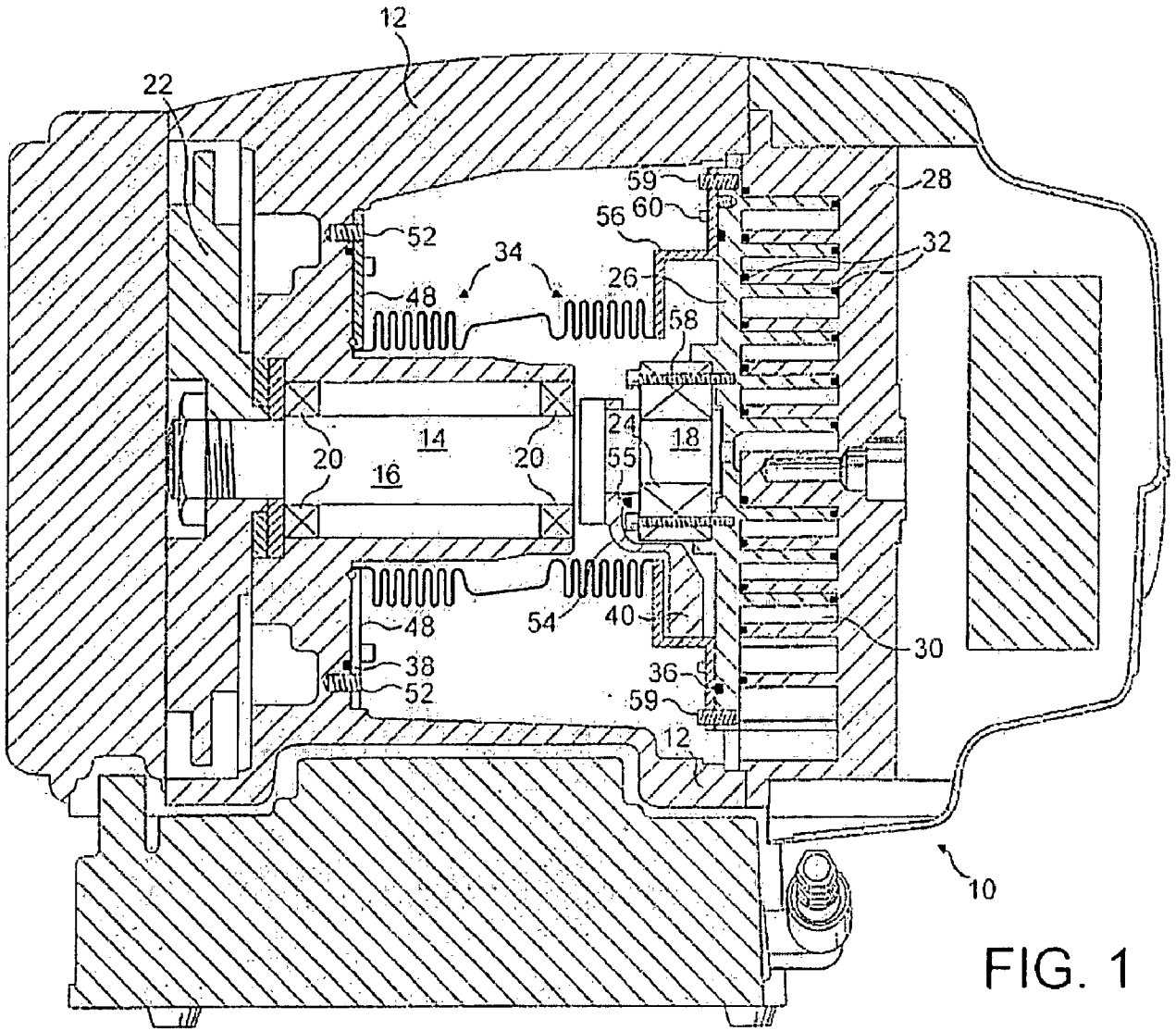
FIG. 1 is a cross-section of a scroll pump.

Referring to FIG. 1, a scroll pump 10 is shown which comprises a housing 12, a drive shaft 14 having a concentric shaft portion 16 and an eccentric shaft portion 18. The shaft is supported at its concentric portion by first bearing means 20 and is driven by a motor 22, both the first bearing means and the motor being mounted in said housing 12. As shown, the first bearing means comprises two rolling bearings that are spaced apart. A second bearing means 24 supports an orbiting scroll 26 on said eccentric shaft portion 18 so that during use rotation of said shaft 14 imparts an orbiting motion to said orbiting scroll 26 which co-operates with a second, fixed. scroll 28 for pumping fluid along a fluid flow path 30 between an inlet and outlet of the pump 10. The second bearing means 24 comprises two rolling bearings as shown. The radial clearances between the orbiting and fixed scrolls are accurately controlled so that lubricant is generally not required for sealing. The axial clearances between the scrolls are sealed with tip seals 32. The arrangement allows a scroll pump to be used when it is desired to maintain a dry environment for the pumping media along the fluid flow path 30. A bellows arrangement 34 isolates the first bearing means 20 and the second bearing means 24 from the fluid flow path 30, which restricts contamination of the pumping media since the bearing means are generally lubricated. O-ring seals 36 and 38 are disposed between the bellows arrangement and orbiting scroll 26 and housing 12, respectively, to resist the passage of contaminants. The bellows arrangement 34 further serves to provide relative rotational location of the orbiting scroll 26 with respect to the second scroll 28. By virtue of the torsional stiffness of the bellows arrangement, the bellows arrangement limits undesirable travel in to circular translation of the orbiting scroll 26 and thus maintains the correct angular position between the second scroll 28 and the orbiting scroll 26. The bellows arrangement may be formed from any suitable material, such as metallic or plastics material, having a sufficient torsional stiffness so as to maintain the correct angular position between the scrolls, whilst having sufficiently flexible to allow orbiting motion of the orbiting scroll 26, second bearing means 24 and eccentric shaft portion 18.

A counter-weight 40 for the orbiting scroll 26 is fixed to the drive shaft 14 so as to be adjacent to the orbiting scroll and generally axially aligned with the second bearing means 24. The relatively small distance between the counter-weight 40 and the orbiting scroll 26 allows the counter-weight to be reduced in mass as compared with the prior art, since the distance from the dynamic counterbalance mounted on the motor rotor 22 is increased. Therefore, the total weight of the pump 10 is reduced.

During assembly, shaft 14, first bearing means 20 and motor 22 are mounted relative to the housing 12. Motor 22 may however be mounted at any suitable stage in the assembly process. As shown, the first bearing means 20 is fixed to housing 12. O-ring 38 is positioned in an accommodating annular recess formed in the housing and then a flange, or flange portion, 48 of the bellows arrangement 34 is fixed relative to housing 12 by fasteners 50. Flange 48 is located in position with dowels 52 before fastening. The orbiting scroll 26 is not fixed to the bellows arrangement 34 when the latter is attached relative to the housing, and therefore it is easier to fasten the first flange 48 of the bellows arrangement 34 to housing 12. The bellows arrangement 34 is itself relatively flexible and the free end (ie. the end thereof to the right in the drawing) can be moved to one side to allow easy access for fastening fastener 50 with a tool.

The counter-weight 40 comprises a shaped arm 54 having a free end which is fitted about and fastened to drive shaft 14 with an axially extending fastener 55. The shaped arm 54, which extends axially and radially, permits the counter-weight to be positioned adjacent the orbiting scroll 26. A second flange, or flange portion, 56 of the bellows arrangement defines an annular recess for accommodating counter-weight 40 so that the counter-weight is positioned axially between the bellows arrangement 34 and the orbiting scroll 26. Unlike the prior art arrangement wherein the counter-weight is fastened to the drive shaft using a radially extending fastener and is positioned between a flexible section of the bellows arrangement and the drive shaft 103, the counter-weight 40 is relatively easily assembled to the drive shaft 14 and positioned relative to the bellows arrangement 34.

The second bearing means 24 is fastened to orbiting scroll 26 with fasteners 58 and then fixed on the eccentric shaft portion 18 of the drive shaft 14. O-ring 36 is fitted in an accommodation annular recess in the orbiting scroll 26 and the orbiting scroll is located in position on the second flange 56 of the bellows arrangement 34 using dowels 59 and fastened with fasteners 60.

Figure 2:
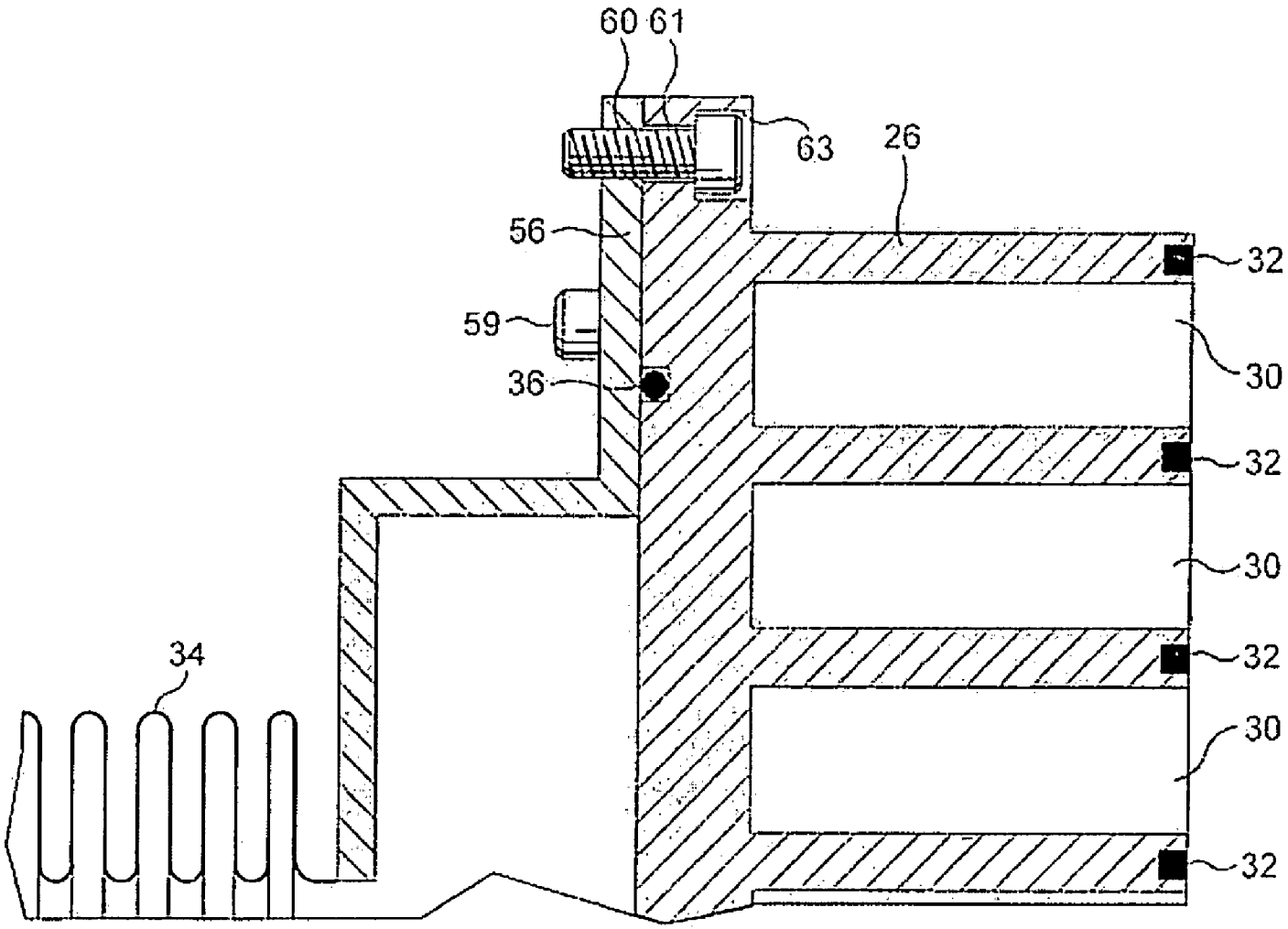
FIG. 2 is an enlarged view of part of the scroll pump shown in FIG. 1.
Figure 3:
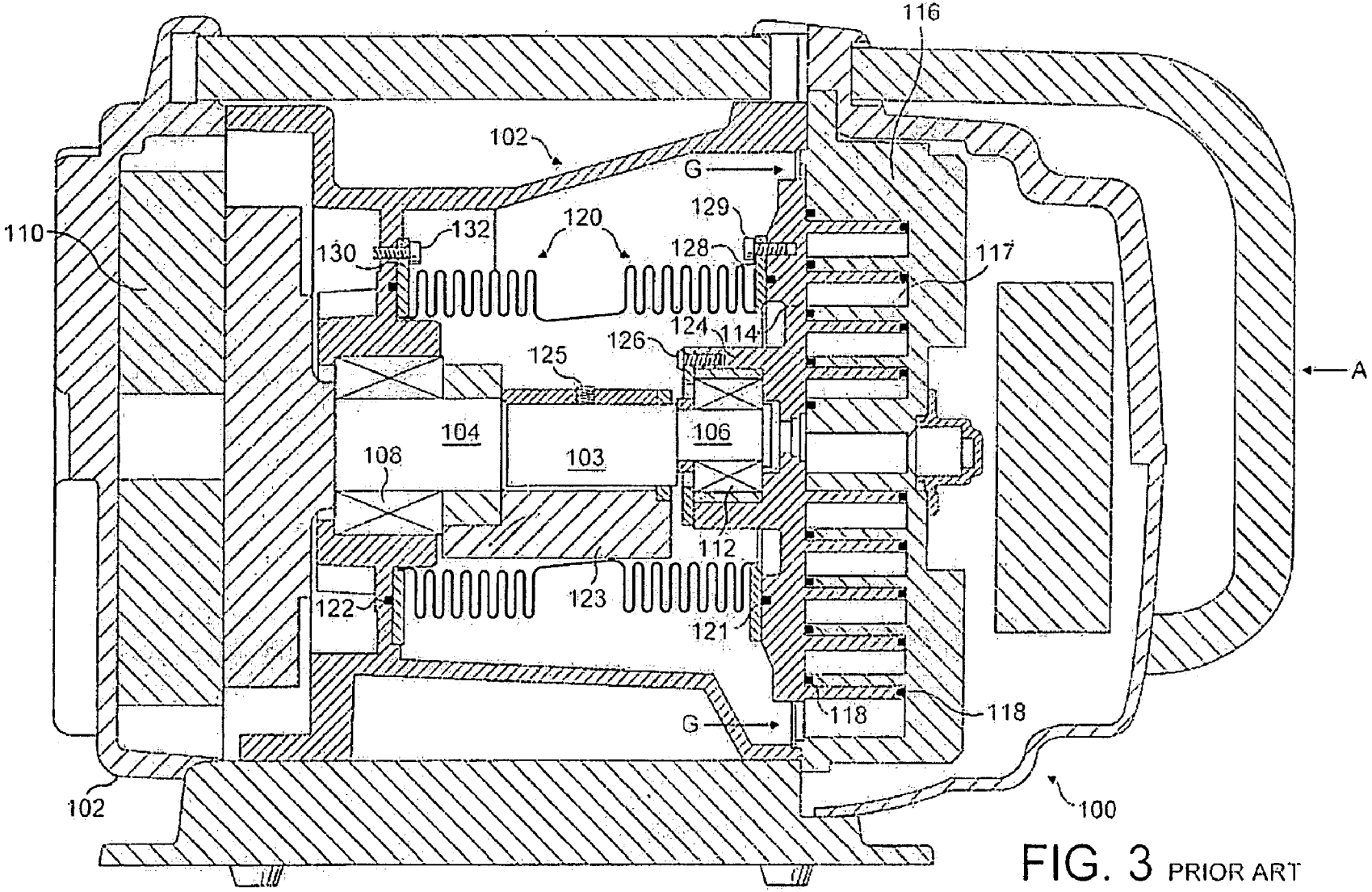
FIG. 3 PRIOR ART
FIG. 3 is a cross-section of the prior art scroll pump described above.

FIG. 2 shows an enlarged view of the orbiting scroll and the second flange. The section shown in FIG. 2 is angularly displaced from the section shown in FIG. 1 so as to show fastener 60 in greater detail. As shown, at least one fastener 60 extends through a through-bore 61 in the orbiting scroll and engages with flange 56. Fastener 60 consists of a screw in FIGS. 1 and 2 but may be any suitable fastener. The orbiting scroll 26 has a counter-sunk recess 63 for accommodating a head of the or each fastener 60 so that it is substantially flush with or recessed from a surface of the orbiting scroll 26, to reduce interference with the tip seal 32 as it passes over the fastener 60 during pumping. The substantially flush or recessed design therefore reduces seepage and increases the life span of the tip seal. The inlet to the scrolls is at a radially outer portion of the fluid flow path whereas the exhaust is towards the center thereof. Accordingly, the through-bore and fastener 60 is formed at a radially outer portion of the fluid flow path where pressure is relatively less than at a radially inner portion. This reduces still further seepage past the tip seal 32.

Accordingly, efficiency of the pump is not significantly affected even through fastener 60 is positioned at a surface of the orbiting scroll defining the fluid flow path 30. Once it has been appreciated that positioning of the fastener in the pumping chamber does not significantly affect efficiency, the diameter of the orbiting scroll can be reduced. This is because the provision of an additional portion radially outwardly of the pumping chamber for receiving the fastener is not required.

The fixed scroll is then located in position and fastened relative to housing 12.

The following steps can be carried out sequentially: mounting the first bearing and the drive shaft for rotation relative to the housing; fastening the first flange portion of the bellows arrangement relative to the housing; fastening the orbiting scroll to the second flange portion of the bellows arrangement; and fixing the second scroll relative to the housing for co-operation with the orbiting scroll, the orbiting scroll being preferably fastened to the second flange portion of the bellows arrangement with at least one fastener which is inserted through the bore in the orbiting scroll.

We claim:

1. A method of assembling a scroll pump, the scroll pump comprising a housing; a drive shaft having an eccentric shaft portion; first bearing means for supporting the drive shaft for rotation; second bearing means for supporting an orbiting scroll on the eccentric shaft portion so that during use rotation of the shaft imparts an orbiting motion to the orbiting scroll which co-operates with a second scroll for pumping fluid along a fluid flow path between an inlet and outlet of the pump; and a bellows arrangement for isolating the first bearing means and the second bearing means from the fluid flow path and for providing relative rotational location of the orbiting scroll with respect of the second scroll; comprising the steps carried out sequentially of:

mounting the first bearing means and the drive shaft for rotation relative to the housing;

fastening a first flange portion of the bellows arrangement relative to the housing;

fastening the orbiting scroll to a second flange portion of the bellows arrangement; and fixing the second scroll relative to the housing for co-operation with the orbiting scroll.

2. The method as claimed in claim 1, further comprising the step of fastening the second bearing means relative to the orbiting scroll and mounting the second bearing means to the eccentric shaft portion prior to the step of fastening the orbiting scroll to the bellows arrangement.

3. The method as claimed in claim 1, further comprising the step of fastening the orbiting scroll to the second flange portion of the bellows arrangement with at least one fastener which is inserted through a bore in the orbiting scroll.

4. The method as claimed in claim 3, further comprising the step of inserting the fastener through the bore so as to be substantially flush with a surface of the orbiting scroll.

5. The method as claimed in claim 1, further comprising the step of fastening a counter-weight for the orbiting scroll to the drive shaft with an axially extending fastener.

6. The method as claimed in claim 5, wherein the step of fastening the counter-weight to the drive shaft takes place subsequently to the step of fastening the first flange portion of the bellows arrangement relative to the housing.

7. A scroll pump comprising:

a housing;

a drive shaft having an eccentric shaft portion;

first bearing means supporting the drive shaft for rotation;

second bearing means supporting an orbiting scroll on the eccentric shaft portion so that during use, rotation of the shaft imparts an orbiting motion to the orbiting scroll which co-operates with a second scroll for pumping fluid along a fluid flow path between an inlet and outlet of the pump; and a bellows arrangement isolating the first bearing means and the second bearing means from the fluid flow path; wherein the bellows arrangement has a first flange portion fastened relative to the housing and a second flange portion fastened to the orbiting scroll with at least one fastener which extends through a through-bore in the orbiting scroll and engages with the second flange portion.

8. The scroll pump as claimed in claim 7, wherein the through-bore extends through a surface of the orbiting scroll defining the fluid flow path.

9. The scroll pump as claimed in claim 7, wherein the fastener is at a radially outer portion of the orbiting scroll.

10. The scroll pump as claimed in claim 7, wherein the through-bore has a counter-sunk recess so that when the fastener is inserted through the through-bore, a head of the fastener is received in the recess and is substantially flush with or recessed from a surface of the scroll pump.

11. The scroll pump as claimed in claim 7, wherein a counter-weight is disposed axially between the bellows arrangement and the orbiting scroll.

12. The scroll pump as claimed in claim 11, wherein the counter-weight is generally axially aligned with the second bearing means.

13. The scroll pump as claimed in claim 11, wherein the counter-weight is fastened to the drive shaft with an axially extending fastener.

14. The scroll pump as claimed in claim 9, wherein the through-bore has a counter-sunk recess so that when the fastener is inserted through the through-bore, a head of the fastener is received in the recess and is substantially flush with or recessed from a surface of the scroll pump.

15. The scroll pump as claimed in claim 9, wherein a counter-weight is disposed axially between the bellows arrangement and the orbiting scroll.

16. The scroll pump as claimed in claim 10, wherein a counter-weight is disposed axially between the bellows arrangement and the orbiting scroll.

17. A method of assembling a scroll pump, the scroll pump comprising: a housing; a shaft supported by a first bearing; an orbiting scroll on an eccentric portion of the shaft supported by a second bearing; and a bellows arrangement; the method comprising the steps carried out sequentially of:

mounting the first bearing and the drive shaft for rotation relative to the housing;

fastening a first flange portion of the bellows arrangement relative to the housing;

fastening the orbiting scroll having a bore to a second flange portion of the bellows arrangement with at least one fastener positioned through the bore; and fixing the second scroll relative to the housing for co-operation with the orbiting scroll.

18. The method as claimed in claim 17, further comprising the step of fastening the second bearing relative to the orbiting scroll and mounting the second bearing to the eccentric shaft portion prior to the step of fastening the orbiting scroll to the bellows arrangement.

19. The method as claimed in claim 17, further comprising the step of inserting the fastener through the bore so as to be substantially flush with a surface of the orbiting scroll.

20. The method as claimed in claim 17, further comprising the step of fastening a counter-weight to the drive shaft with an axially extending fastener.

21. The method as claimed in claim 20, wherein the step of fastening the counter-weight to the drive shaft takes place subsequent to the step of fastening the first flange portion of the bellows arrangement relative to the housing.

* * * * *